US006276584B1

(12) United States Patent
McLachlan

(10) Patent No.: US 6,276,584 B1
(45) Date of Patent: Aug. 21, 2001

(54) TRAMPER'S PACK

(75) Inventor: Fraser Bruce McLachlan, Christchurch (NZ)

(73) Assignee: Macpac Wilderness Equipment Limited (NZ)

( * ) Notice: Subject to any disclaimer, the term of this patent is extended or adjusted under 35 U.S.C. 154(b) by 0 days.

(21) Appl. No.: 09/575,755

(22) Filed: May 22, 2000

(30) Foreign Application Priority Data

May 24, 1999 (NZ) ..... 335931

(51) Int. Cl.[7] ..... A45F 3/04
(52) U.S. Cl. ..... 224/637; 224/633; 224/262
(58) Field of Search ..... 224/627, 631, 224/637, 641, 644, 259, 261, 262, 630

(56) References Cited

U.S. PATENT DOCUMENTS 3,840,162 * 10/1974 Horenstein et al. .
4,479,595 * 10/1984 Opsal .
4,676,418 * 6/1987 Lowe ..... 224/262 X
4,982,884 * 1/1991 Wise .
5,341,974 * 8/1994 Robinson et al. .
5,704,530 * 1/1998 Sherer ..... 224/632
5,725,139 * 3/1998 Smith ..... 224/637
5,823,414 * 10/1998 Gal et al. ..... 224/637
5,890,640 * 4/1999 Thompson ..... 224/630
5,954,253 * 9/1999 Swetish ..... 224/631
6,024,265 * 2/2000 Clements ..... 224/630

* cited by examiner

*Primary Examiner*—Gregory M. Vidovich
(74) *Attorney, Agent, or Firm*—Ross, Ross & Flavin

(57) ABSTRACT

A tramper's pack includes a sac 3, a shoulder harness 6/7, a supporting frame 4 and a hip belt; the frame 4 is secured to the rear surface of the sac 3 between the top of the sac 3 and a position approximately level with the wearer's lumbar dorsal pivot, but is free to flex relative to the sac below that point; the lower end of the frame 4 is load bearingly connected to the hip belt 9; a load spreading member 20 which incorporates a pair of wing portions 20 a is arranged to spread load from the area of the lumbar dorsal pivot outwards downwards to contact points on the hip belt 9, to which the wings are connected by flexible connection means.

14 Claims, 8 Drawing Sheets

TRAMPER'S PACK

FIELD OF THE INVENTION

The present invention relates to improvements in a tramper's pack.

BACKGROUND OF THE INVENTION

A modern tramper's pack consists of a sac in which equipment may be carried, the sac being mounted on a frame, and a shoulder harness secured to the sac or to the frame. Since carrying a heavy load supported only from the shoulders can lead to backache or even to back damage, a majority of modern packs also include a hip belt which is connected to the sac or the frame, generally at or close to the base of the sac, to transfer some of the load from the shoulders to the hips.

Although using a hip belt reduces the strain on the back, the belt itself can cause problems to the wearer, due to the way in which the human body moves when walking.

When a human being walks, he leans backwards and forwards with each step (FIG. 1) and from side to side with each double step (FIG. 2). As he leans to the supporting side when taking a step the torso compresses on that side and extends on the stepping side (FIG. 3): this means that, viewing the person from the front, the person's hips pivot up and down around an imaginary center line (indicated in broken lines in FIG. 3). This is termed 'up and down' movement in the present specification. In addition, as shown in FIG. 4, the person's hips move with his legs, but his torso and arms swing in the opposite direction, with the body pivoting at the waist. In FIG. 4, a line through the shoulders is indicated by line S—S and a line through the hips is indicated by line H—H. As shown in FIG. 4, there is a considerable relative rotation between the shoulders (line S—S) and the hips (line H—H) with each step. This is termed 'twisting' movement in the present specification.

Also, when a human being bends or steps up, his back extends:—the further the person leans forwards, the longer his back becomes. This extension of the back is in a curved plane, following the natural curve of the back.

Because of the above described movements, a hip belt which is rigidly secured to the pack, and which therefore moves with the pack, is very uncomfortable for the wearer, because the hip belt is constantly rubbing against the wearer due to the relative movements of different parts of the wearer's body when walking. The hip belt cannot be loosened to prevent this rubbing, because the belt must fit snugly to transmit load to the wearer's pelvic girdle and relieve the load on his back. FIG. 5 of the accompanying drawings shows, in diagrammatic form, the effect of a person wearing a pack with a rigidly-secured hip-belt bending forwards; the back extension raises the pack and lifts the hip-belt from the hips, applying uncomfortable pressure across the front of the lower abdomen (arrow P).

The above described problem was partially solved by the pivotal hip belt connection provided by New Zealand patent No. 201751 (Macpac Wilderness Equipment Limited) dated Jul. 25, 1983.

However, the hip belt described in New Zealand patent No. 201751 was not a complete solution to the problem:—because the hip belt was secured to the pack by a comparatively narrow connection, the load transfer from the pack to the hip belt was concentrated at the connection point and was distributed around the pelvic girdle of the wearer only by the stiffness of the hip belt. The more rigid the hip belt, the better the load transfer, but in general, the more rigid a hip belt is, the less comfortable it is to wear. Thus, the problem remained of providing a harness which permitted relative movement between the wearer's back and hips in at least three directions but which provided an efficient load transfer around the pelvic girdle of the wearer without resorting to the use of an uncomfortably stiff hip belt.

There have been a number of other attempts to solve this problem: for example, U.S. Pat. No. 5,503,314 dated Apr. 2, 1996 proposes a back pack carrier incorporating a crisscross framework which is designed to have inherent flexibility because of its sinusoidal shape and which also is made of flexible material. The carrier also incorporates a separate shock absorbing mechanism. The base of the crisscross framework is rigidly secured to a hip belt; thus, any flexing of the hip belt relative to the pack is governed by the flexibility of the crisscross framework.

International patent application PCT/US97/11152 discloses a load support system which consists of a flexible frame unit made of a shaped plate of flexible material formed with lugs or out riggers which extend around the sides of the wearer and are secured to pivots attached to the sides of a hip belt. This gives a pivotal connection between the frame unit and the hip belt, but only in a vertical plane: any twisting of the wearer's hips relative to the wearer's shoulders has to be accommodated by the flexibility of the frame unit itself.

International patent application PCT/US97/13396 discloses an internal frame back pack in which the frame is formed by a shaped sheet of resilient material reinforced with resilient rods. The lower edges of the backpack are rigidly secured to a hip belt, so that any twisting of the wearer's hips relative to the wearer's shoulders again has to be accommodated by the flexibility of the frame.

In all three of the above inventions, the frame is described as "flexible". However, a backpack frame cannot be extremely flexible, or it simply will not support the load in the pack. Further, no matter how flexible a frame is in itself, it will lose much of its flexibility when the pack is loaded, since the presence of a full, heavy, essentially rigid, loaded pack secured to the frame makes it difficult for the frame to flex very much.

It is therefore an object of the present invention to overcome the above described problems by providing a pack in which part of the load is transferred efficiently from the shoulder harness to the pelvic girdle of the wearer via the hip belt, without sacrificing a flexible connection between the sac and the hip belt to allow comfortable movement as described above, and without resorting to an uncomfortably stiff hip belt.

SUMMARY OF THE INVENTION

A tramper's pack including a sac, a shoulder harness adapted to support the pack upon a wearer's shoulders, a frame arranged to support the sac, and a hip belt connected to the sac; wherein:— a) the frame is secured to the rear surface of the sac between a first position adjacent the top of the sac and a second position approximately level with the wearer's lumbar dorsal pivot, but is free to flex relative to the sac below said second position;

b) the pack further includes a load spreading member which provides a pair of wing portions symmetrically arranged about a central portion which is connected to the frame or to the rear surface of the sac, said wing portions extending from at or adjacent said second position symmetrically downwards and outwards relative to the sac;

c) the lower end of said frame is load bearingly connected to said hip belt at or adjacent a third position lower down the rear surface of the sac than said second position;

d) the only load transmitting connection between each said wing portion and said hip belt comprises a flexible connection means; one of said flexible connection means extending from at or adjacent the free end of one of said wing portions to a fourth position on said hip belt spaced a predetermined distance from said third position in one direction along the length of the hip belt, and the other of said flexible connection means extending from at or adjacent the free end of the other of said wing portions to a fifth position on said hip belt spaced said predetermined distance from said third position in the other direction along the length of the hip belt.

The connections between the frame and the sac at the first and second positions may be connections at one or more points or connections along a line.

The frame may be a flat or a shaped plate or may be one or more frame bars; preferably, the frame consists of two spaced longitudinal frame bars and a frame cross piece running along the top of the pack.

Preferably, the free ends of the wing portions of the load spreading member transfer load to the hip belt at two points at or adjacent the iliac crest of the wearer in use.

BRIEF DESCRIPTION OF THE DRAWINGS

By way of example only, preferred embodiments of the invention are described in detail with reference to the accompanying drawings in which:—

DETAILED DESCRIPTION OF THE PREFERRED EMBODIMENTS

Figure 1:
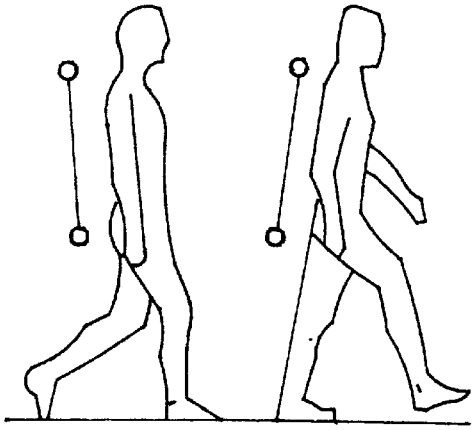
FIGS. 1–5 are diagrams showing the movement of the human body when walking.
Figure 2:
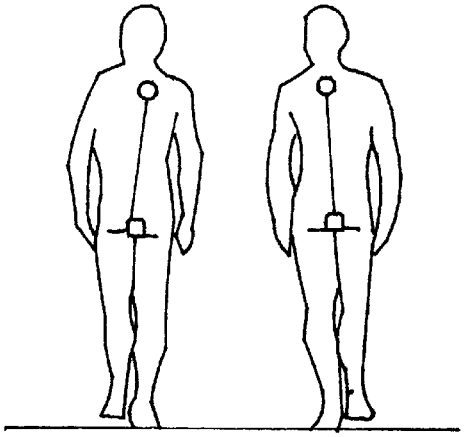
Figure 3:
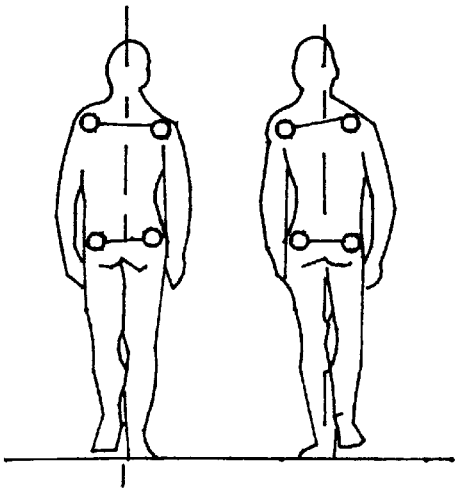
Figure 4:
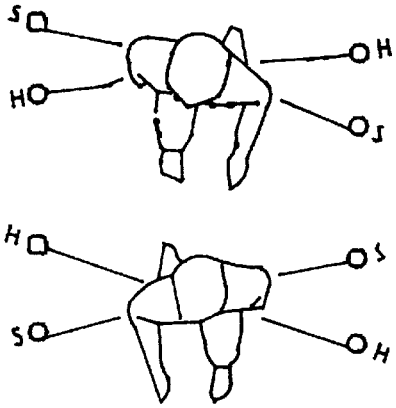
Figure 5:
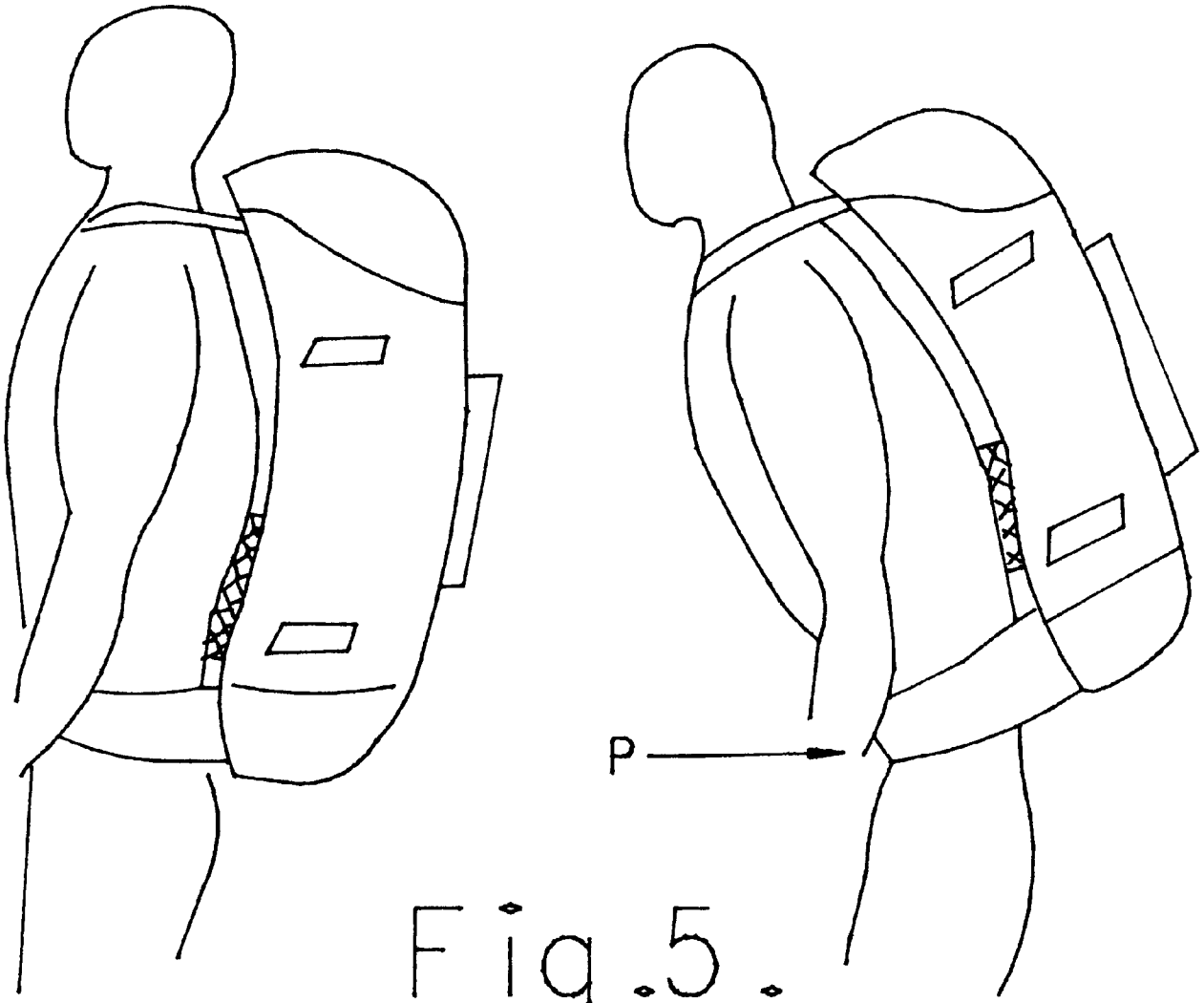
Figure 6:
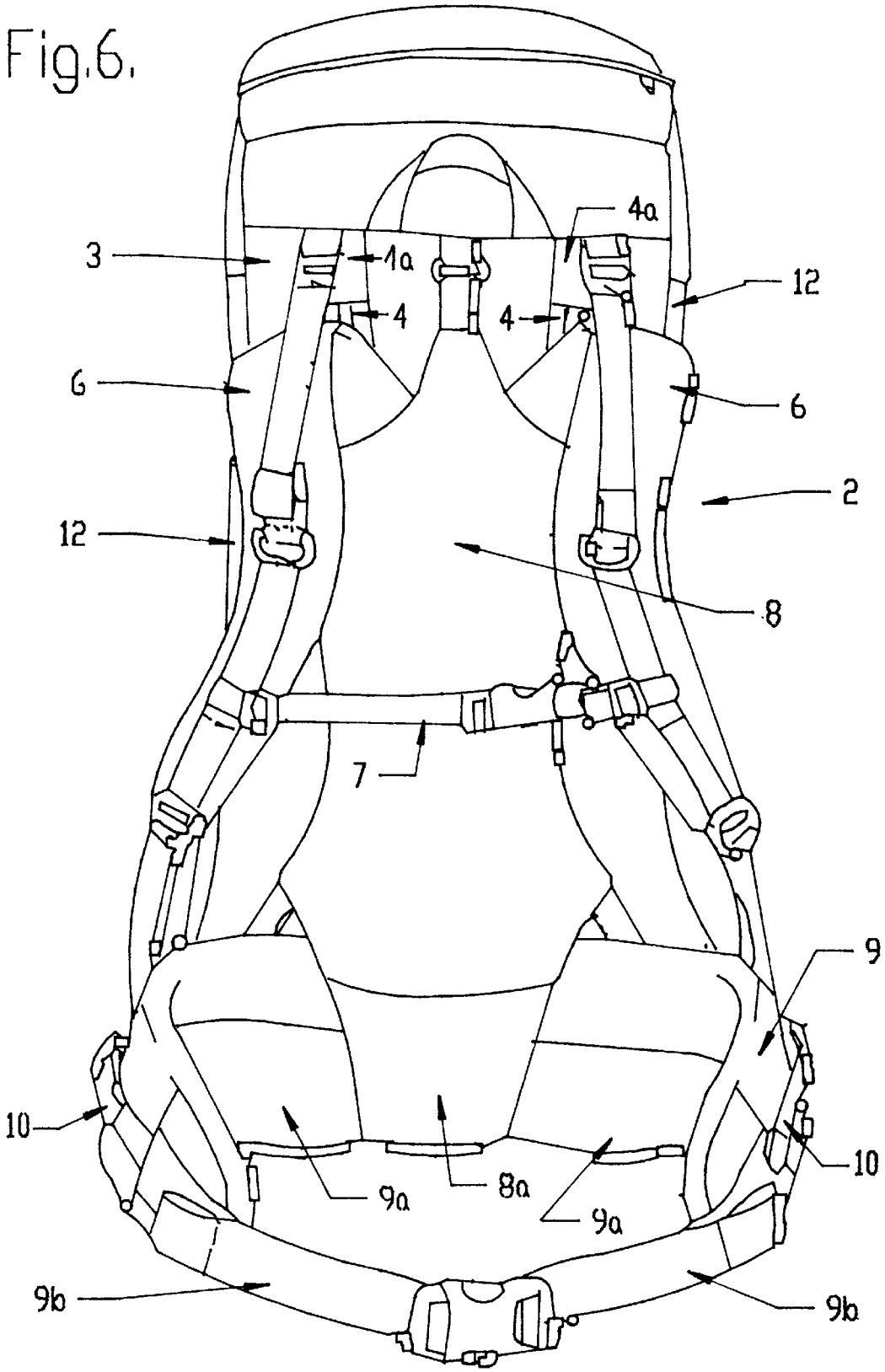
FIG. 6 is a sketch perspective view of a tramper's pack incorporating the present invention.

Referring to FIG. 6, a tramper's pack 2 in accordance with the present invention comprises a sac 3 of known type, framed by a frame which comprises two spaced apart longitudinal frame members 4, and a cross piece 5 (FIG. 7 only) which extends across the upper part of the sac 3. The frame members 4 are curved in the longitudinal plane to mimic the wearer's dorsal curve, and extend the full length of the main portion of the sac 3.

A shoulder harness comprising two padded shoulder straps 6 and a chest strap 7 is adjustably secured to the frame in known manner. A section of heavy padding 8 is secured to the rear outer surface of the sac between the shoulder straps 6, to protect the back of the wearer from rubbing by the frame members 4 and by the contents of the sac. Alternatively, the shoulder harness could be secured to the sac, also in known manner.

A padded, shaped hip belt 9 is secured to the frame and the sac by a central connection as described below and by spaced apart adjustable straps 10, each of which extends between the hip belt at a position corresponding to the wearer's iliac crests, and the corresponding lower corner 3*a* of the sac 3. FIG. 6 shows the hip belt secured near the base of the sac, but it will be appreciated that the sac may extend below the hip belt.

The portion 9*a* of the hip belt 9 which extends around the back of the wearer and forward on the wearer as far as, or just beyond, the wearer's hips, is wide and heavily padded and is relatively rigid, being just flexible enough to wrap around the wearer comfortably. The portion 9*b* of the hip belt which fastens the belt across the front of the wearer comprises two lengths of flexible webbing which are adjustable in length. Each length of webbing is secured at one end to the corresponding end of the portion 9*a*, and carries part of a buckle 11 at the other end.

Figure 7:
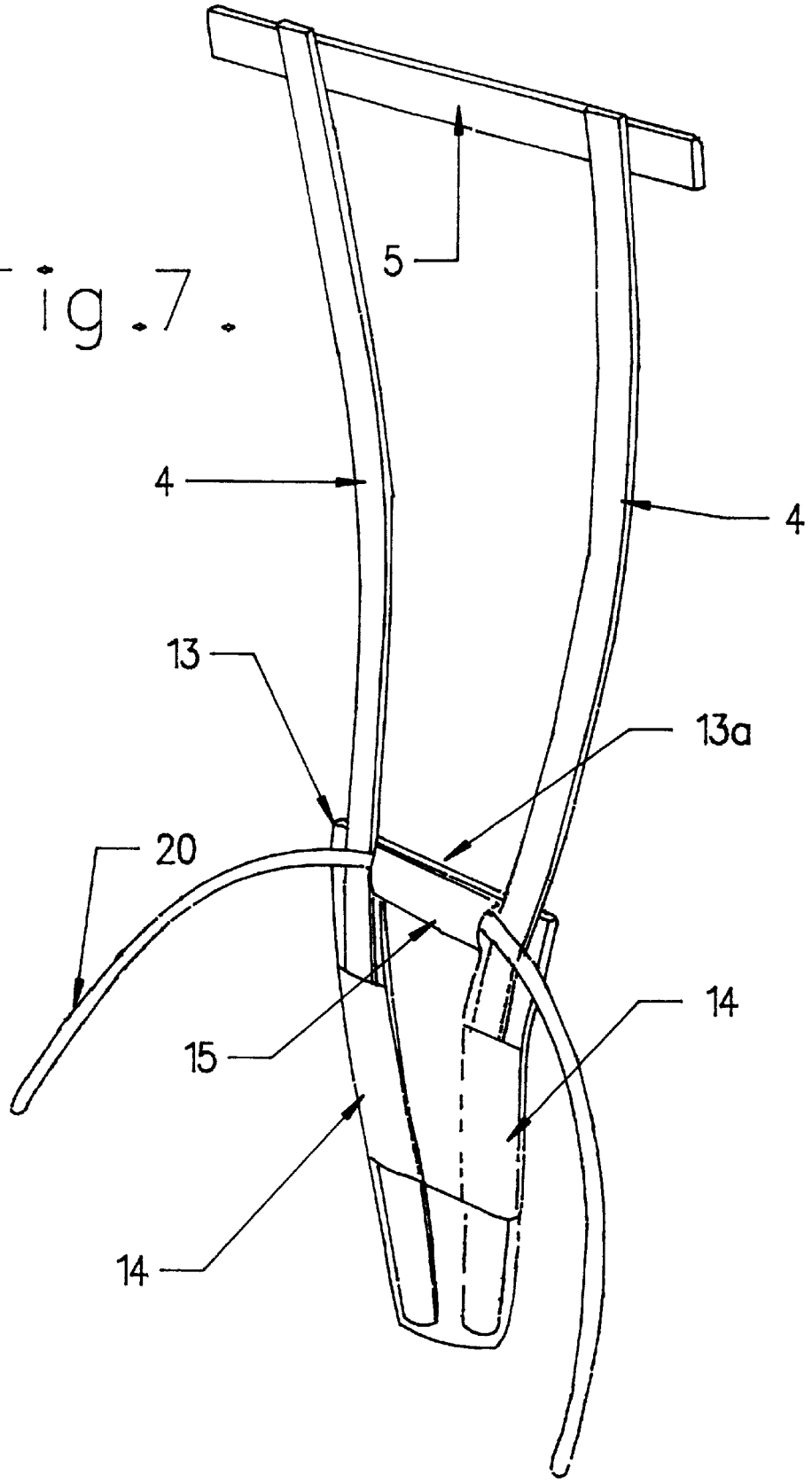
FIG. 7 is an isometric view of part of the internal supports for the pack of FIG. 6.
Figure 8:
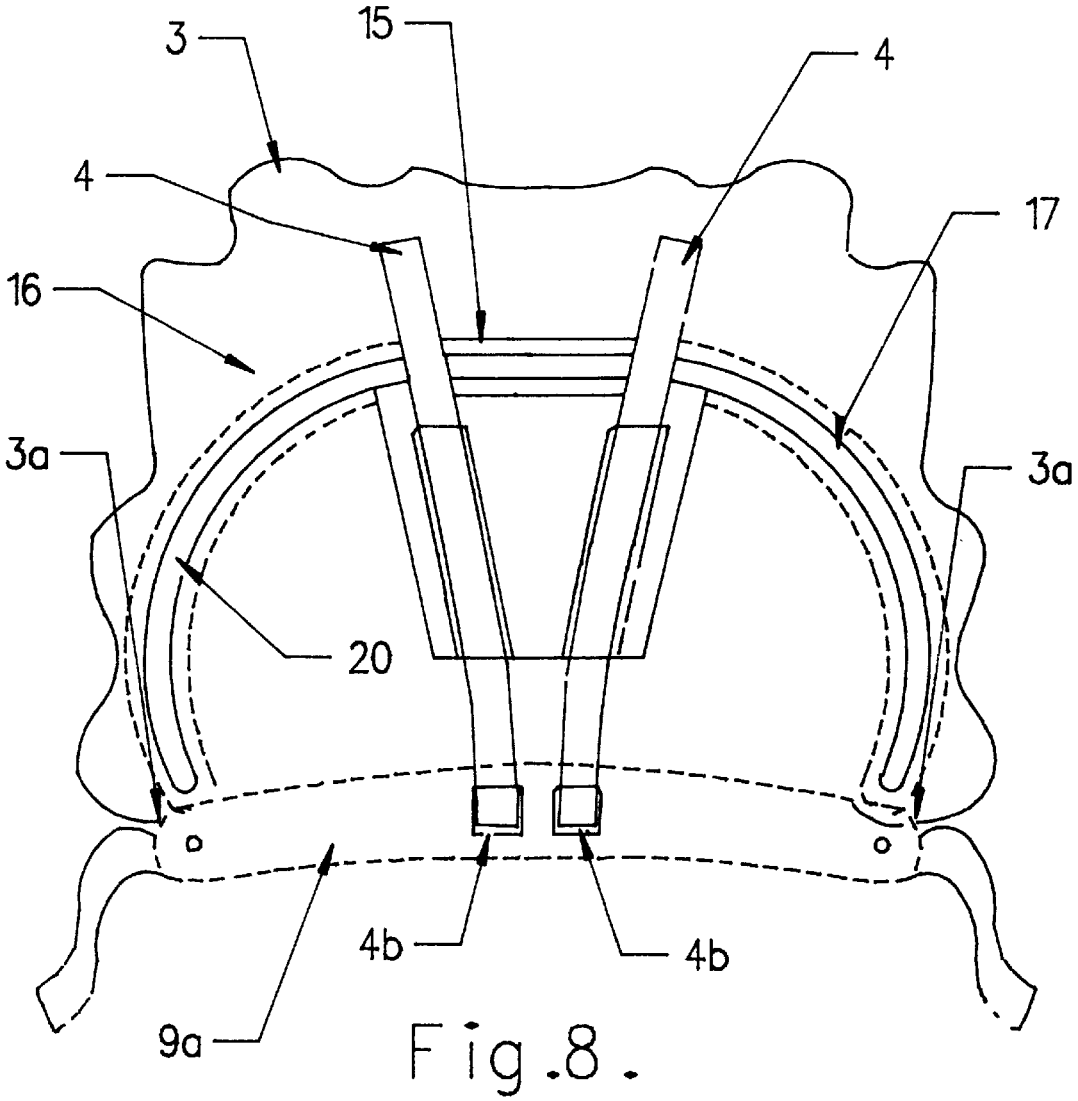
FIG. 8 is a sketch view of the lower part of the internal supports of FIG. 7 in place in the pack.

Referring to FIGS. 6, 7, and 8, the upper end of each frame member 4 is received in a socket 4*a* rigidly secured to the rear surface of the sac 3 at a first position adjacent the top of the main portion of the sac. As used herein, the term "rear surface of the sac" means the surface of the sac which in use is nearest to the back of the wearer. The lower end of each frame member 4 is received in a socket 4*b* which is secured to the outer surface of the padded portion 9*a* of the hip belt 9. As used herein, the terms "outer surface" means that surface of the hip belt which in use is not in contact with the back of the wearer.

As shown in FIGS. 7 and 8, the frame members 4 are spaced relatively far apart at the upper ends, so as to lie beneath the corresponding shoulder straps 6, close to the side edges 12 of the sac 3. The lower ends of the frame members 4 lie close together, with the sockets 4*b* arranged one on either side of the mid point of the portion 9*a* of the hip belt. Down the back of the sac 3, the frame members 4 lie flat against the back of the sac 3 and pass through spaced fabric loops (not visible) at intervals, to tie the frame members 4 to the sac 3.

At a second position on the rear surface of the sac corresponding approximately to the position of the lumbar dorsal pivot of the wearer, a tongue 13 is secured to the central portion of the rear surface of the sac and extends downwards to a point adjacent the lower edge of the hip belt 9. The tongue 13 is made of stiffened, slightly flexible fabric and provides two sleeves 14 adjacent each longitudinal edge of the tongue through which the lower portions of the frame members 4 pass. The lower end of each sleeve 14 is open, so that the lower end of each frame member 4 passes through the end of the sleeve 14 to be received in the sockets 4*b* on the hip belt.

The tongue 13 is secured to the sac only along the upper edge 13*a* of the tongue, so that the lower end of the tongue hangs free of the sac. The length of the edge 13*a* lies substantially perpendicular to, and symmetrically either side of, the longitudinal axis of the rear surface of the sac. The padding 8 is formed with a wrap around portion 8*a* at its lower end; this wrap around portion extends over the center back of the padded portion 9*a* of the inner surface of the hip belt 9, and wraps around the lower edge of the hip belt, extending a short distance up the back of the hip belt to be secured to the edge of the tongue 13. In this way, the hip belt is secured to the sac and frame at a third position on the rear surface of the sac, and the frame members 4 are urged into firm engagement with the lower sockets 4*b*, preventing accidental disengagement of the frame members 4 from the sockets even if the pack is jolted or shaken.

As shown in FIGS. 7 and 8, a channel 15 is formed along the upper edge 13*a* of the tongue 13, extending across the back of the sac. Corresponding channels 16,17 (FIG. 8 only) are formed as a pair of arcs, one channel 16 extending from adjacent one end of the channel 15 in a smooth curve across the rear surface of the sac, ending adjacent one lower rear corner 3*a* of the sac; the other channel 17 extending from adjacent the other end of the channel 15 in a smooth curve across the rear surface of the sac, ending adjacent the other lower rear corner 3*a* of the sac. The points at which the channels 16, 17 end are close to the points at which the sac is secured to the hip belt by the straps 10.

A substantially rigid load spreading member 20 extends through the channels 15,16 and 17. The load spreading member 20 consists of a pair of wing portions 20*a* extending symmetrically outwards from a central portion 20*b*. The central portion 20*b* extends through the channel 15 and the wing portions 20*a* are received in the channels 16 and 17 respectively. It is essential that the load spreading member is sufficiently rigid to transmit load efficiently from the sac 3 out to the free ends of the wings 20*a* in the channels 16 and 17. Typically, the load spreading member 20 is made from a circular cross-section aluminium alloy tube. By this means, part of the weight of the sac in use is transmitted from the vicinity of the wearer's lumbar dorsal pivot out to the ends of the channels 16 and 17 and hence to fourth and fifth positions respectively on the hip belt 9 adjacent the iliac crests of the wearer, by virtue of the contact between the ends of the channels 16 and 17 and the padded portion 9*a* of the hip belt when the straps 10 are tightened to draw the lower corners of the sac 3 into firm, load transmitting contact with the corresponding portions of the hip belt 9. Said fourth and fifth positions are substantially equidistantly spaced from said third position.

Thus, when the sac is loaded and the pack is in use, part of the load is carried on the shoulder straps 6, part of the load is transmitted from the vicinity of the wearer's lumbar dorsal pivot to the center back of the hip belt 9 by the frame members 4 engaging in the lower sockets 4*b*, and part of the load is transmitted to the hip belt adjacent the ends of the padded portion 9*a* of the hip belt, at approximately the iliac crests of the wearer. It will be appreciated that it is desirable to spread the load around the wearer as much as possible, and therefore it is desirable to arrange that the free ends of the wings 20*a* contact the hip belt as close to the wearer's iliac crests as possible. Thus, whilst it would be possible to have the fourth and fifth positions only a short distance from the third position, this would not achieve optimal load transfer.

It will be noted that the frame members 4 are not fastened to the sac below the point of attachment of the tongue 13. This gives the pack considerable additional flexibility because the frame and the sac are free to pivot relative to each other approximately at the area corresponding to the lumber dorsal pivot of the wearer. The lumber dorsal pivot is the most static point on the spine, located between the two major curves of the spine:—the lumbar curve and the thoracic curve. These two major curves of the spine provide freedom to move:—the thoracic curve gives freedom to use the arms, shoulders, neck and upper back, and the lumbar curve enables the lower back, legs, buttocks and hips to move freely. As the lumber dorsal pivot is relatively static and is located between these two major curves, transferring weight from this point will not inhibit the body's freedom to move. Thus, the point which the frame and the sac pivot relative to each other corresponds as closely as possible to the point which the wearer's body naturally pivots. Transferring part of the weight of the sac directly from the area of the lumbar dorsal pivot to the center back of the hip belt 9 by means of the frame members 4 engaging in the lower sockets 4*b*, and transferring another part of the weight of the sac directly from the area of the lumber dorsal pivot to the vicinity of the wearer's iliac crests by means of the load spreading member 20, combines to give a highly advantageous weight transfer whilst still retaining a great deal of flexibility.

In use, although the load of the pack is transmitted efficiently and is well distributed, as described above, the pack nevertheless allows considerable freedom of movement by the wearer:—because the load is transmitted from the sac frame to the hip belt at three widely spaced points (the center back of the hip belt and adjacent the iliac crests of the wearer) there is freedom for adequate relative twisting movement between the wearer's back and hips; the fact that the tongue 13 and the hip belt 9 both possess a degree of flex allows for adequate up and down movement; and the fact that the frame and sac are free to pivot relative to each other at approximately the lumber dorsal pivot point of the wearer permits adequate movement in a curved plane parallel to the plane of the wearer's back. It will be appreciated that the construction is such that no matter how heavy the load in the pack, the above described flexibility is not compromised, unlike constructions which rely for their flexibility upon the use of a flexible frame. Additional flexibility is achieved because the straps 10 which connect the lower part of the pack to the outer portions of the hip belt are flexible, allowing for relative movement between the wings of the load spreading member 20 in the channels 16 and 17, and the corresponding portions of the hip belt. If additional flexibility is required, then the straps 10 may be loosened; this allows a large amount of relative movement between the lower part of the pack and the hip belt, at the cost of reducing the amount of load transferred by the ends of the wings 20*a* to the iliac crests of the wearer.

It would be possible for the frame members 4 to be mounted on the inner side of the rear surface of the sac, from the top of the sac to just above of the position of the edge 13*a*. However, this variant involves the frame members extending through apertures formed in the sac at or adjacent edge 13*a*, and is not preferred for this reason.

Figure 9:
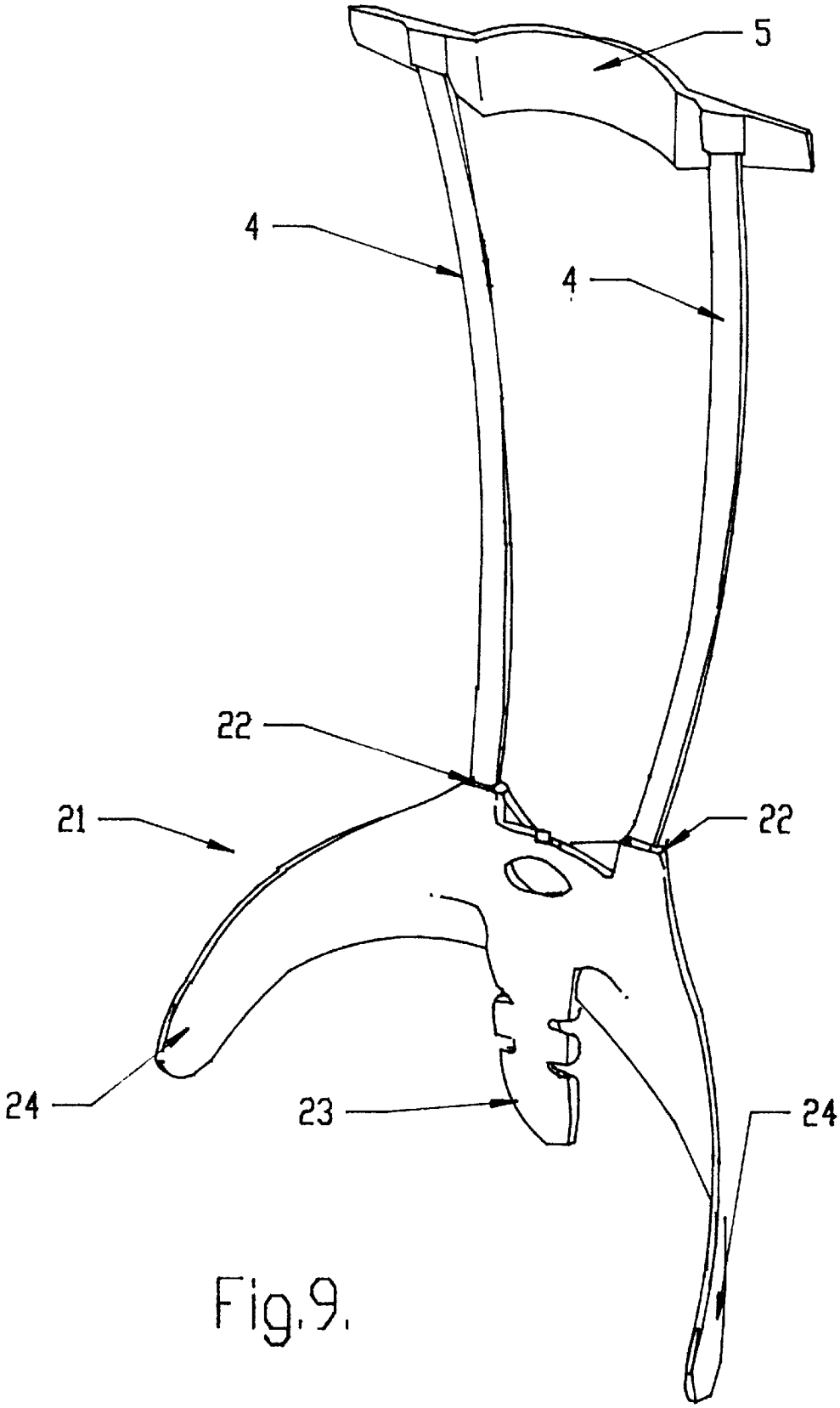
FIG. 9 is an isometric view of part of an alternative embodiment of the present invention.

Part of a second embodiment of the present invention is shown in FIG. 9. In this embodiment, the tongue 13, channels 15, 16 and 17, and load spreading member 20 are replaced by a single component 21 molded from a strong, relatively rigid but slightly flexible plastics material. The frame members 4 are shorter than in the first embodiment, terminating in sockets 22 formed in the upper edge of the component 21 at a level corresponding to the top of the tongue 13 in the first embodiment, i.e. approximately level to a wearer's lumbar dorsal pivot. The component 21 provides a downward extension 23 which engages a socket (not shown) formed in the center back of the hip belt 9 and performs the same function as the combination of the tongue 13 and the lower ends of the frame members 4 in the first embodiment, i.e. provides a flexible weight transmitting connection between the area of the lumbar dorsal pivot and the centre rear of the hip belt. Two curved wings 24 are secured to the lower portion of the sac by means of channels corresponding to channels 16 and 17 in the first embodiment, each wing 24 terminating at one of the lower rear corners 3*a* of the sac. The wings 24 act in the same manner as the wings 20*a* in the first embodiment in transmitting load from the area of the lumbar dorsal pivot to points on the hip belt adjacent the wearer's iliac crests. The second embodiment functions in the same manner as the first embodiment.

It is preferred that the wings 20*a*/24 of the load spreading member are secured to the sac e.g. by means of channels such as channels 16 and 17. However, this is not essential:—adequate load transfer is still achieved if the load transmitting member is secured to the frame/sac only at the second position.

It will be appreciated that it is not essential for the wings 20*a*/24 to extend right to the bottom of the sac or right to the sides of the sac:—adequate load transfer can be achieved even if the sac extends outwards and/or downwards beyond the free ends of said wings.

Figure 10:
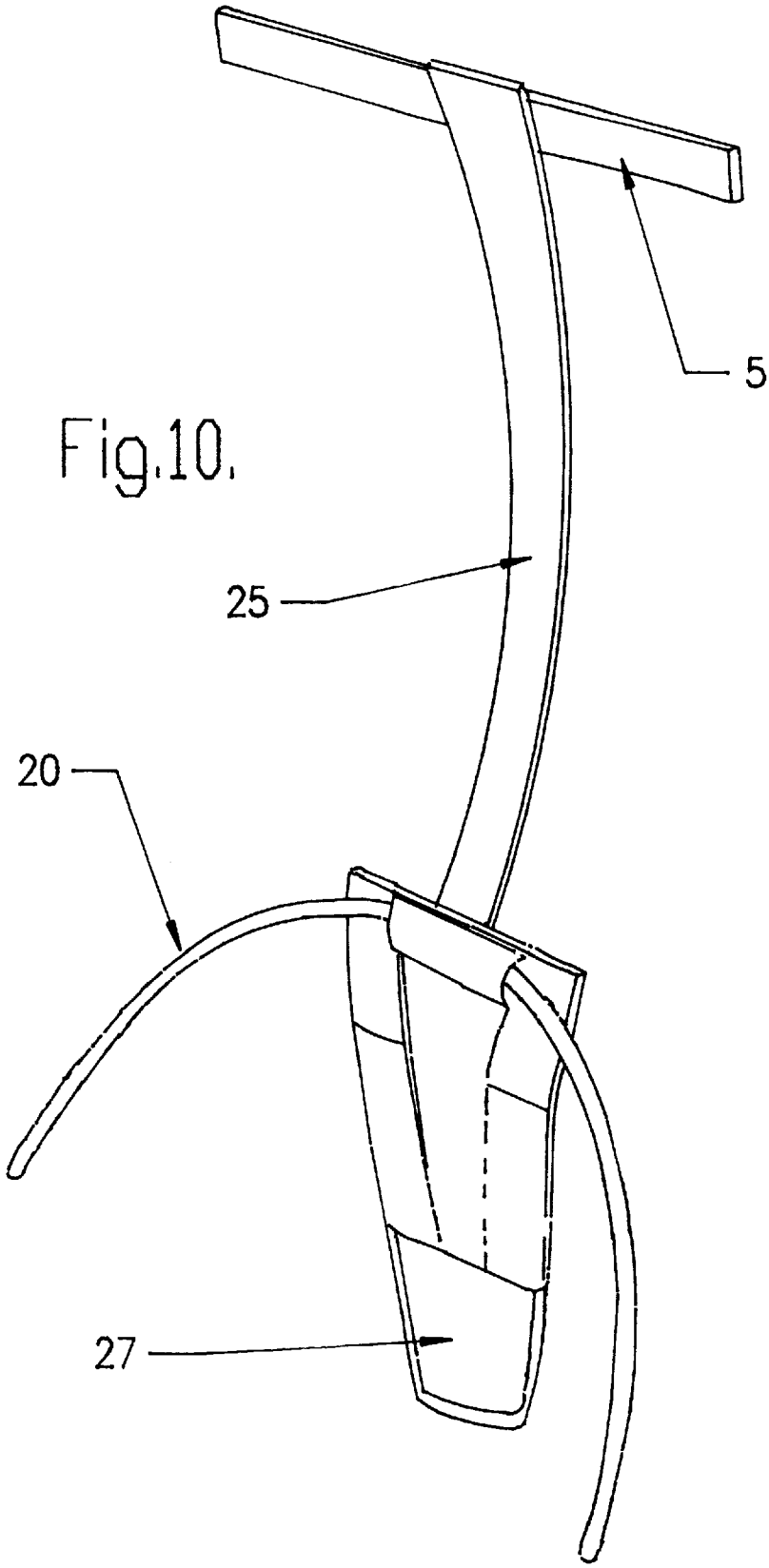
FIGS. 10 and 11 are sketch views similar to FIG. 7, showing further possible variants of the internal supports, with the load spreading member indicated in broken lines.

FIG. 10 shows a variant of the frame in which only a single frame bar 25 is used. The single frame bar extends down the center rear face of the sac; the upper end of the frame bar 25 is received in a socket (not shown) secured to the rear of the sac, and the lower end of the frame bar 25 is received in a socket 27 mounted on the rear face of the hip belt. In all other respects the frame is constructed, and operates, in the same manner as frame described with reference to FIGS. 6–8.

Figure 11:
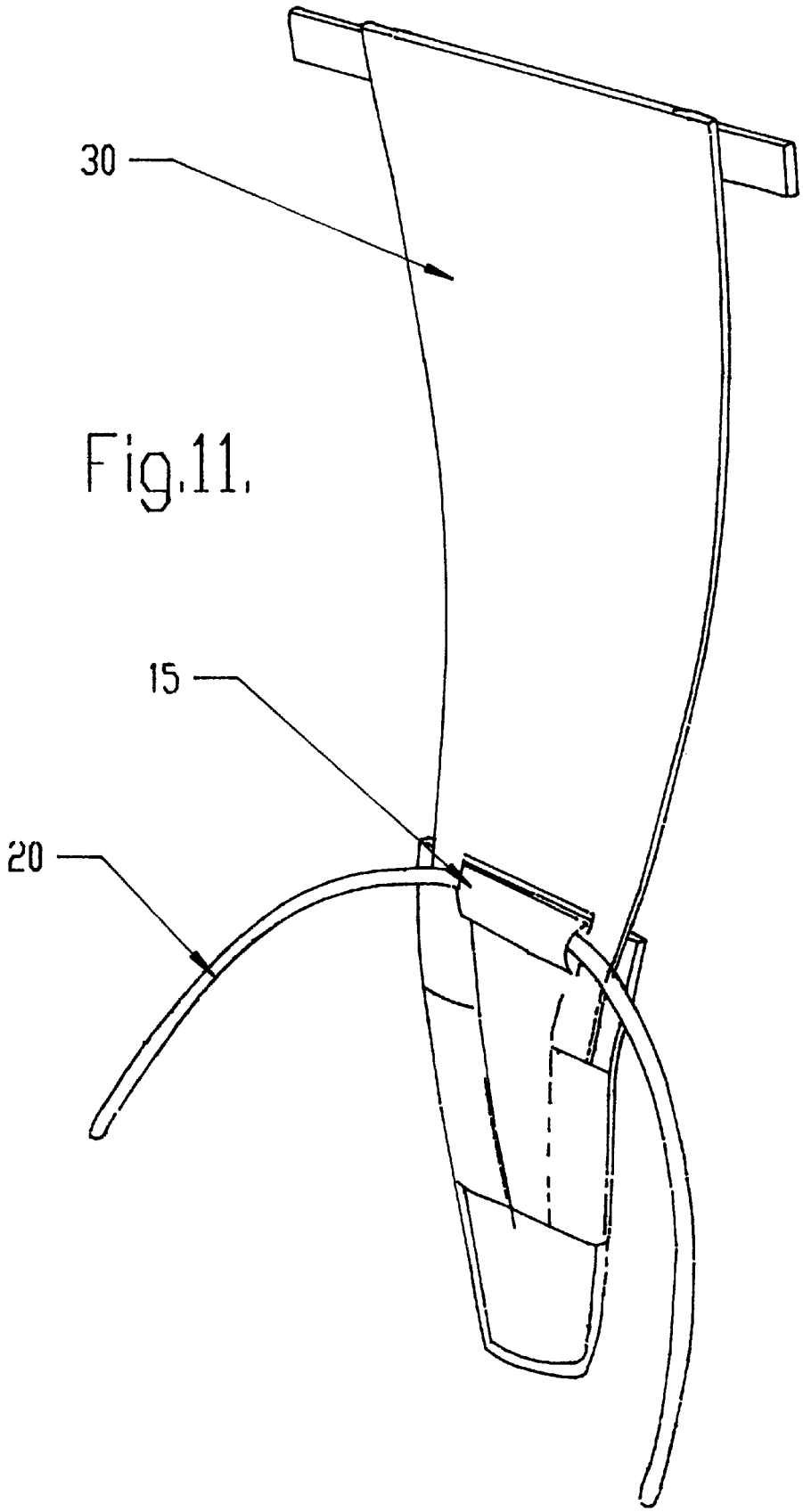

FIG. 11 shows a further variant in which the frame is formed from a shaped plate 30. This variant operates in the same manner as the frame described with reference to FIGS. 6–8, except that channel 15 for the load spreading member is formed on one face of the plate rather than on the tongue 13.

In the above described embodiments, the load spreading member 20/wings 24 are shown as a single unitary structure. However, it will be appreciated that the load spreading member 20/wings 24 may be formed as a series of connected segments if preferred. Further, the load spreading member 20/wings 24 may be formed integrally with the frame bars 4/25 or with the frame plate 30.

What is claimed is:

1. A tramper's pack including a sac, a shoulder harness adapted to support the pack upon a wearer's shoulders, a frame arranged to support the sac, and a hip belt connected to the sac; wherein:— a) the frame is secured to the rear surface of the sac between a first position adjacent the top of the sac and a second position approximately level with the wearer's lumbar dorsal pivot, but is free to flex relative to the sac below said second position;

b) the pack further includes a load spreading member which provides a pair of wing portions symmetrically arranged about a central portion which is connected to the frame or to the rear surface of the sac, said wing portions extending from at or adjacent said second position symmetrically downwards and outwards relative to the sac;

c) the lower end of said frame is load bearingly connected to said hip belt at or adjacent a third position lower down the rear surface of the sac than said second position;

d) a flexible connection means defines an only load transmitting connection between each said wing portion and said hip belt; one of said flexible connection means extending from at or adjacent the free end of one of said wing portions to a fourth position on said hip belt spaced a predetermined distance from said third position in one direction along the length of the hip belt, and the other of said flexible connection means extending from at or adjacent the free end of the other of said wing portions to a fifth position on said hip belt spaced said predetermined distance from said third position in the other direction along the length of the hip belt.

2. The tramper's pack as claimed in claim 1, wherein said fourth and fifth positions on said hip belt are at or adjacent the iliac crests of a wearer in use.

3. The tramper's pack as claimed in claim 1, wherein said hip belt is flexibly connected to the sac at or adjacent said third position.

4. The tramper's pack as claimed in claim 1, wherein the lower end of the frame is load bearingly connected to said hip belt at or adjacent said third position by means of one or more sockets provided on the hip belt.

5. The tramper's pack as claimed in claim 1, wherein the shoulder harness is secured to the frame.

6. The tramper's pack as claimed in claim 1, wherein the shoulder harness is secured to the sac.

7. The tramper's pack as claimed in claim 1 or claim 2, wherein the central portion of the load spreading member is formed integrally with said wing portions.

8. The tramper's pack as claimed in claim 1 or claim 2, wherein said load spreading member is separate from said frame.

9. The tramper's pack as claimed in claim 1 or claim 2, wherein said load spreading member is formed integrally with said frame.

10. The tramper's pack claimed in any one of the claims 1–3, wherein said wings are secured to said sac.

11. The tramper's pack as claimed in claim 1, wherein said frame comprises a single bar extending down the length of said sac and a cross piece across the top of the sac.

12. The tramper's pack as claimed in claim 1, wherein said frame comprises two spaced bars extending down the length of said sac and a cross piece across the top of the sac.

13. The tramper's pack as claimed in claim 1, wherein said frame comprises a shaped plate.

14. The tramper's pack as claimed in claim 1, wherein between said second and third positions, said frame is connected to a flexible tongue which is secured to said sac only at or adjacent said second position.

* * * * *